United States Patent [19]

Lewis et al.

[11] Patent Number: 4,880,485

[45] Date of Patent: Nov. 14, 1989

[54] METHOD OF MAKING ORNAMENTAL CASTINGS CONTAINING STAINED GLASS

[76] Inventors: Thomas H. Lewis; Suzan K. Lewis, both of 1477 Mullins Station, Memphis, Tenn. 38134

[21] Appl. No.: 224,737

[22] Filed: Jul. 27, 1988

[51] Int. Cl.[4] ..... E06B 3/54

[52] U.S. Cl. ..... 156/108; 52/308; 52/311; 156/63; 156/107; 156/245; 428/38

[58] Field of Search ..... 52/308, 311; 156/63, 156/107, 108, 245; 428/38

[56] References Cited

U.S. PATENT DOCUMENTS

| | | | |
|---|---|---|---|
| 1,686,809 | 10/1928 | Grau | 428/38 X |
| 2,991,213 | 0/1959 | Williams . | |
| 4,217,326 | 12/1980 | Goralnik | 264/254 |
| 4,343,758 | 8/1982 | Goralnik | 428/38 X |
| 4,610,901 | 9/1986 | Linscott | 428/38 |

OTHER PUBLICATIONS

Encyclopedia Britannica, vol. 17, p. 568, Column 1.

*Primary Examiner*—Robert A. Dawson

[57] ABSTRACT

This invention relates to devices and methods of manufacturing ornamental metals and castings using a pattern plate having a parting line where half of the pattern is on the drag side and half of the pattern is on the cope side and the apertures of the drag side are sufficiently larger than the corresponding apertures of the cope side, such that when the impact surfaces of the matchplate are pressed into the flask, a recess is formed around the entire perimeter of the apertures and cut glass inserts, especially stained glass, are positioned in the recesses and affixed into place by use of a sealant.

2 Claims, 1 Drawing Sheet

METHOD OF MAKING ORNAMENTAL CASTINGS CONTAINING STAINED GLASS

BACKGROUND OF THE INVENTION

The present invention relates to devices and methods of manufacturing ornamental castings including a plurality of cut glass pieces, especially stained glass, that are arranged in a predetermined pattern. The method comprises making a double-face matchplate in which sections of one side are recessed and resultingly one side of the casting is recessed to accept the cut glass pieces. The cut glass pieces are positioned into the predetermined pattern of the casting and are affixed into place by use of an uncured sealant.

Here-to-fore, ornamental castings have been made from a double-face matchplate that is pressed into a slurry-sand mixture and the resulting cavity is filled with molten metal. The resulting castings have been for the most part mirror images with only minor differences in the front and back of the casting. In addition, these castings tend to be rather drab due to the fact most are painted in the traditional solid colors of either black or white. The castings have been used almost exclusively by those who are trained and skilled in working with metal and more recently those who build and install metal security doors.

Here-to-fore, stained glass panels have been used in windows and doors, but when used in doors, the traditional problems of weak solder joints, deteriorating caulking and extreme weight of large panels have limited their use in high traffic areas. In addition, although some recent advances in methods and materials have been introduced, the average person is unable to build such panels without training and skill.

The novelty of the present embodiment is that of providing recessed areas on the original double-face matchplate and resultingly, all castings made from the matchplate that will accept the cut glass pieces, especially stained glass, cut to a predetermined pattern. The present embodiment adds the elegance and beauty of stained glass to ornamental metal while maintaining the strength and durability of the ornamental metal. The cut glass pieces are positioned into the recessed areas of the casting by first applying the sealant to the lip and lower wall area of the recess, inserting the cut glass piece and applying additional sealant to the upper wall area of the recess and the abutting edge and rim of the glass giving a finished look and making the glass appear to be an integral part of the casting.

OBJECTS AND ADVANTAGES

Among the several objects of this invention is to provide ornamental castings that have the color, elegance, beauty and desirability of stained glass while maintaining the strength, endurance and security of ornamental metal.

Another object is to provide castings that can be used by the average person to enhance existing full view doors and be used in other decorating and construction situations.

The above brief description, as well as other advantages and objects of the present embodiment, will become apparent in the following detailed description of the invention thereof in conjunction with accompanying drawings, wherein:

Figure 1:
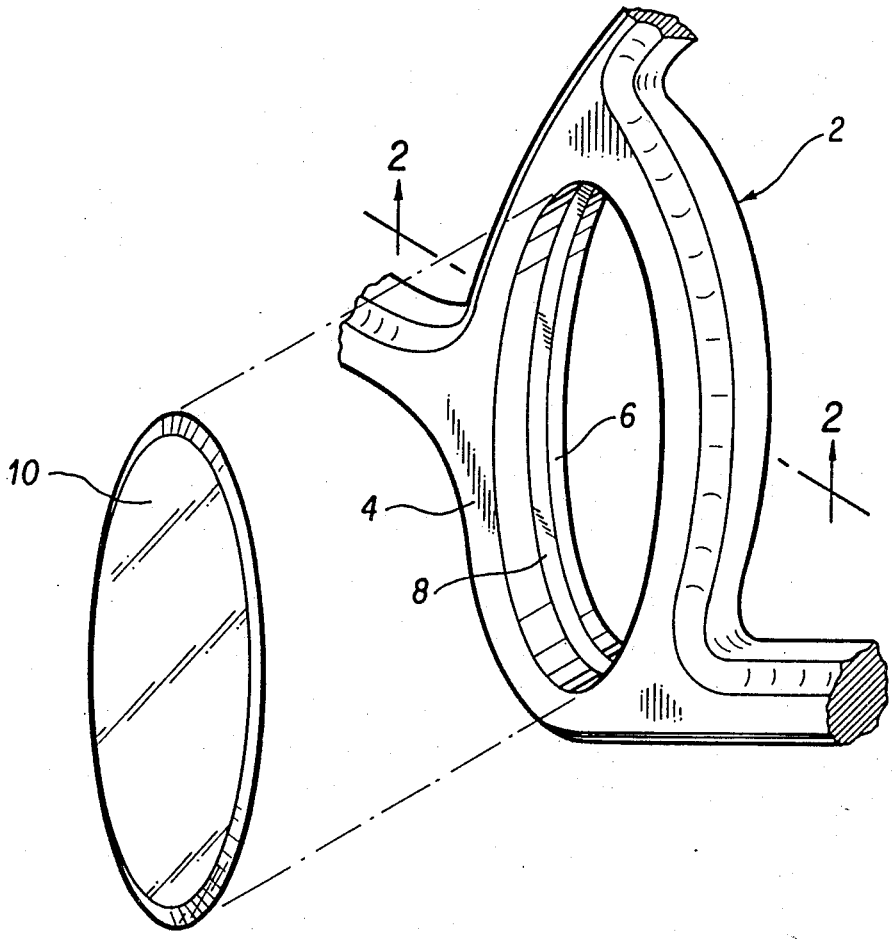
FIG. 1 is an isometric view of a section of an ornamental metal sand casting showing recess area formed in accordance with the present invention.

LIST OF REFERENCE NUMERALS 2 is the metal sand casting.

4 is the side of the casting formed by the drag side of the pattern plate.

6 is the side of the casting formed by the cope side of the pattern plate.

8 is the recess formed by the drag side aperture being larger than the corresponding aperture of the cope side.

10 is the cut glass insert.

12 is the sealant which holds and seals the glass in the metal.

DETAILED DESCRIPTION OF THE INVENTION

In accordance with the present invention, ornamental sand castings containing stained glass can be produced. Moreover, such castings have the beauty and elegance of stained glass without the traditional negatives associated with the art. Furthermore, the strength and durability or ornamental metal is retained in the castings, and said castings can be produced by a simple, economical and efficient manufacturing process by use of a pattern plate having a parting line where half of the pattern is on the drag side and half of the pattern is on the cope side, and the apertures of the drag side are sufficiently larger than the corresponding apertures of the cope side, such that when the impact surfaces of the pattern plate are pressed into the flask and the casting is poured, a recess is formed around the entire perimeter of the apertures and cut glass inserts, especially stained glass, are positioned in the recesses and affixed into place by use of a sealant.

Referring to FIG. 1, an isometric view of a section of an ornamental sand casting 2 showing the drag side 4 of the casting 2 formed by the drag side of the pattern plate and the cope side 6 of the casting 2 formed by the cope side of the pattern plate illustrating the resulting recess 8 formed by the drag side 4 aperture being larger than the corresponding cope side 6 aperture. The stained glass insert 10 is inserted into the recess 8.

Figure 2:
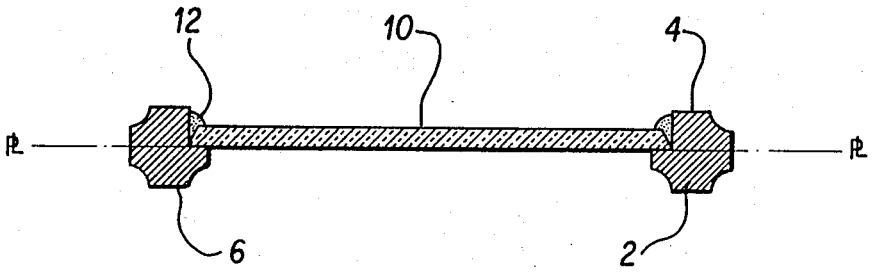
FIG. 2 is a cross-sectional view with glass sealed in recess taken along section 202 of FIG. 1 in accordance with the present invention.

Referring to FIG. 2, a cross-sectional view of casting 2 taken along section 2—2 of FIG. 1 showing the cut glass insert 10 affixed into recess 8 by use of a sealant 12.

CONCLUSION AND SCOPE OF THE INVENTION

While the preceding description contains many specifications, these should not be contrued as limitation on the scope of the invention, but rather as an exemplification of the preferred embodiment thereof. Many other variations are possible. For example, one skilled in the art could produce a casting with recessed areas on both sides of the castings or produce a two-piece casting with recessed areas whereby the glass is sandwiched between the two halves. One could find different material for the glass inserts or even bevel the glass. One skilled in the art could produce the castings in different metals or combinations of metals or even plastics. Accordingly, the scope of the invention should be determined not by the embodiments illustrated, but by the appended claims and their legal equivalents.

What is claimed is:

1. A method of manufacturing ornamental castings containing stained glass with a pattern plate having drag and cope sides:

A. whereby a double face matchplate is made having a parting line and half of the pattern is on the drag side and half on the cope side;

B. whereby the apertures of the drag side are sufficiently larger than the corresponding apertures of the cope side such that when the casting is poured, a recess is formed around the entire perimeter of the apertures;

C. whereby the recess apertures are one or more;

D. whereby the castings are made of iron, aluminum or other moldable material.

E. whereby the recessed areas are designed to accept inserts;

F. where the inserts are stained glass or other material which allows light to pass.

2. The method of claim three, further comprising the steps of: positioning the inserts into the recesses; sealing the inserts into place with an adhesive type material.

* * * * *